US006949717B2

(12) United States Patent
Haluschka et al.

(10) Patent No.: US 6,949,717 B2
(45) Date of Patent: Sep. 27, 2005

(54) PLUG HEATER FOR A PENCIL-TYPE GLOW PLUG AND CORRESPONDING GLOW PLUG

(75) Inventors: Christoph Haluschka, Klingenberg (DE); Andreas Reissner, Stuttgart (DE); Peter Sossinka, Ditzingen (DE); Christoph Kern, Aspach (DE); Wolfgang Dressler, Vaihingen/Enz (DE); Laurent Jeannel, Ditzingen-Hirschlanden (DE); Steffen Schott, Schwieberdingen (DE); Ruth Hoffmann, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/466,007

(22) PCT Filed: Oct. 31, 2002

(86) PCT No.: PCT/DE02/04048

§ 371 (c)(1),
(2), (4) Date: Dec. 5, 2003

(87) PCT Pub. No.: WO03/040624

PCT Pub. Date: May 15, 2003

(65) Prior Publication Data

US 2004/0079745 A1 Apr. 29, 2004

(30) Foreign Application Priority Data

Nov. 9, 2001 (DE) ..... 101 55 230

(51) Int. Cl.[7] ..... F23Q 7/22
(52) U.S. Cl. ..... 219/270; 219/544

(58) Field of Search ..... 219/260, 268, 219/270, 544; 123/145 A, 145 R; 361/264–266

(56) References Cited

U.S. PATENT DOCUMENTS

| | | | | |
|---|---|---|---|---|
| 4,682,008 A | | 7/1987 | Masaka | |
| 4,742,209 A | | 5/1988 | Minegishi et al. | |
| 4,914,274 A | * | 4/1990 | Hatanaka et al. | 219/270 |
| 5,158,050 A | * | 10/1992 | Hawkins et al. | 123/145 A |
| 5,191,508 A | * | 3/1993 | Axelson et al. | 361/257 |
| 5,206,484 A | * | 4/1993 | Issartel | 219/270 |
| 5,304,778 A | * | 4/1994 | Dasgupta et al. | 219/270 |
| 6,054,680 A | * | 4/2000 | Locher et al. | 219/270 |

FOREIGN PATENT DOCUMENTS

DE 100 53 327 5/2002

* cited by examiner

*Primary Examiner*—Teresa J. Walberg
(74) *Attorney, Agent, or Firm*—Kenyon & Kenyon

(57) ABSTRACT

A pin heater in a sheathed-element glow plug and a sheathed-element glow plug for internal combustion engines, which have improved electrical and mechanical properties, are described. The pin heater has at least one essentially internal insulating layer and one essentially external first conductive layer, both layers including ceramic composite structures. The pin heater includes a second conductive layer, which also includes a ceramic composite structure. The second conductive layer is bonded to the first conductive layer in the region of a combustion chamber side tip of the pin heater. The second conductive layer runs inside the insulating layer.

18 Claims, 2 Drawing Sheets

(A-A)

(B-B)

PLUG HEATER FOR A PENCIL-TYPE GLOW PLUG AND CORRESPONDING GLOW PLUG

FIELD OF THE INVENTION

The present invention is directed to a pin heater in a sheathed-element glow plug and a sheathed-element glow plug.

BACKGROUND INFORMATION

A pin heater in a sheathed-element glow plug for diesel engines, which has at least one essentially internal insulating layer and at least one essentially external conductive layer, both layers including ceramic composite structures, is already known from German Published Patent Application No. 100 53 327. In this way, the external conductive layer is U-shaped in cross-section in the region of a combustion chamber side tip of the pin heater, so that the external conductive layer encloses the insulating layer in the region of the combustion chamber side tip of the pin heater.

SUMMARY OF THE INVENTION

The pin heater according to the present invention and the sheathed-element glow plug according to the present invention have the advantage over this related art that the pin heater has a second conductive layer, which also includes ceramic composite structures, the second conductive layer is connected to the first conductive layer in the region of a combustion chamber side tip of the pin heater, and the second conductive layer runs inside the insulating layer. In this way, external electrical insulation of the pin heater against a reference potential, such as the vehicle frame, may be dispensed with if the first conductive layer is provided as the outgoing line, and thus intended for the connection to the reference potential, and the second conductive layer is provided as the supply line, and therefore intended for the connection to an operating voltage potential, such as the positive terminal of a vehicle battery. The second conductive layer is then already electrically insulated to the outside by the insulating layer with the exception of the region of the combustion chamber side tip of the pin heater. Therefore, an insulating layer which electrically insulates the pin heater to the outside may be dispensed with and the manufacturing cost may thus be reduced.

It is especially advantageous if the first conductive layer is connected to a reference potential, in particular the vehicle frame, and the second conductive layer is connected to an operating voltage potential, in particular the positive terminal of the vehicle battery. In this way, external electrical insulation of the pin heater may be dispensed with, as described.

It is especially advantageous if the first conductive layer, the second conductive layer, and the insulating layer are arranged essentially rotationally symmetrically in cross-section. In this way, isotropic shrinking of the insulating layer and the conductive layers may be implemented during the manufacturing of the pin heater, during which gaseous substances are separated from the particular ceramic material through heating.

Furthermore, during operation of the pin heater in the internal combustion engine and the cyclic heating and cooling of the pin heater connected therewith, thermally induced, mechanical stresses due to the differing thermal expansions of the insulating layer and the conductive layers may be significantly reduced.

The essentially rotationally symmetric arrangement of the insulating layer and the two conductive layers also results in improved concentricity of the pin heater.

The thermal and mechanical carrying capacity of the pin heater and therefore its service life are thus increased in this way.

It is also advantageous if the insulating layer has a preferred direction in cross-section, in which it is implemented as thicker than in at least one other direction. In this way, bending of the insulating layer during the manufacturing process of the pin heater, in particular during bonding of the insulating layer to the first conductive layer, is largely prevented. The mechanical robustness of the pin heater is thus elevated. In addition, the electrical resistance is elevated in the preferred direction, so that less leakage current flows between the first conductive layer and the second conductive layer in this direction.

A further advantage is that the second conductive layer has a preferred direction in cross-section, in which it is expanded compared to at least one other direction. In this way, bending of the insulating layer during the manufacturing process of the pin heater, in particular during the connection of the second conductive layer to the insulating layer, is largely prevented. The mechanical robustness of the pin heater is also thus elevated.

It is also advantageous if the first conductive layer is made of a first ceramic material in the region of the combustion chamber side tip of the pin heater, the first conductive layer is otherwise made of a second ceramic material, and the first ceramic material has a higher electrical resistivity than the second ceramic material. In this way, a higher electrical resistance may be implemented for the first conductive layer in the region of the combustion chamber side tip of the pin heater than outside the region of the combustion chamber side tip. Therefore, the heating of the pin heater may be concentrated at the region of the combustion chamber side tip of the pin heater.

This advantage also results if the proportion of the insulating layer in the overall cross-section increases in the region of the combustion chamber side tip of the pin heater, while the proportion of the two conductive layers in the overall cross-section is reduced.

DETAILED DESCRIPTION

Figure 1:
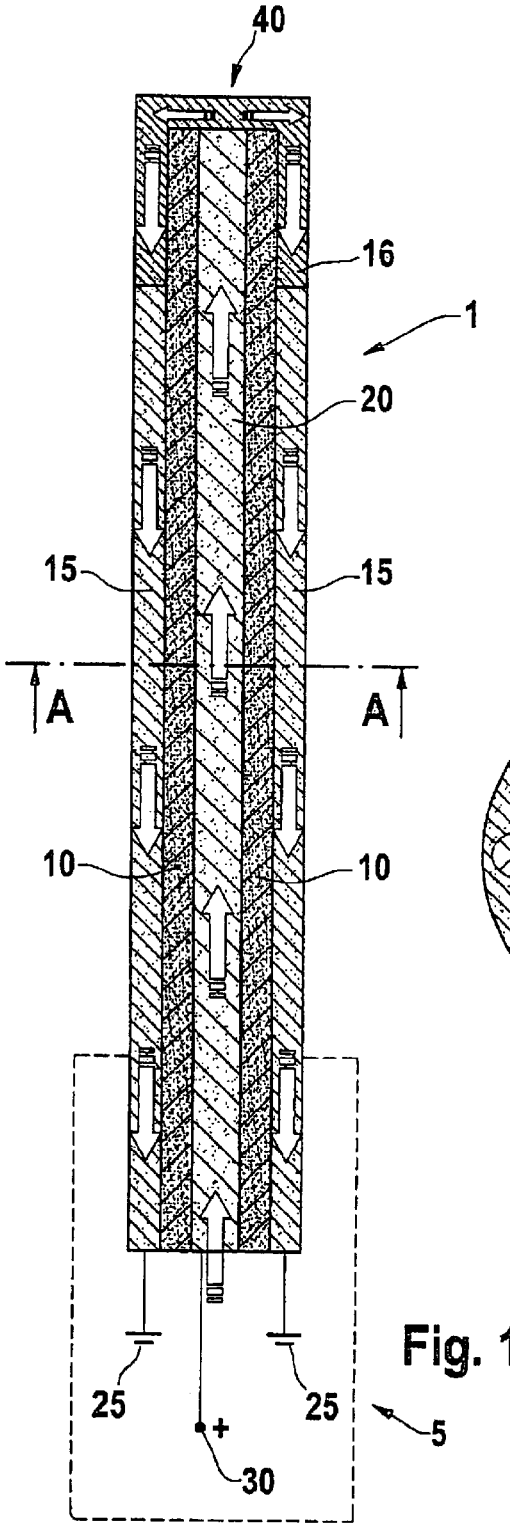
FIG. 1 shows a longitudinal section through a pin heater of a sheathed-element glow plug according to a first embodiment.
Figure 2:
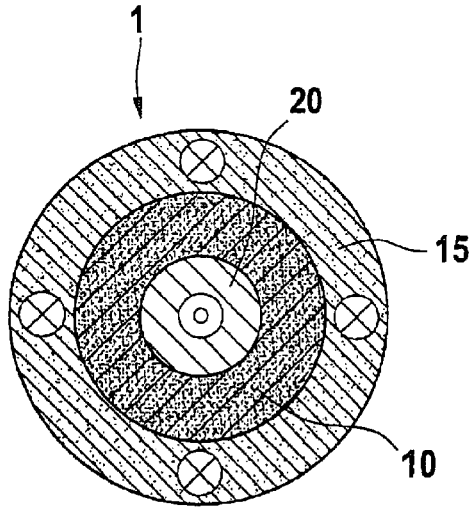
FIG. 2 shows a cross-section of this pin heater according to the first embodiment.

In FIG. 1, 5 identifies a sheathed-element glow plug for installation in a cylinder head of an internal combustion engine, a diesel engine, for example. Sheathed-element glow plug 5 includes a pin heater 1. Further components of sheathed-element glow plug 5, which relate to the attachment of pin heater 1 in the housing or the attachment of sheathed-element glow plug 5 in a cylinder head of an internal combustion engine, for example, are not shown for the sake of clarity. Pin heater 1 is shown in longitudinal section in FIG. 1. Pin heater 1 includes an essentially internal insulating layer 10, which is enclosed by an essentially external first conductive layer 15, 16 and which encloses a second conductive layer 20. Second conductive layer 20 therefore runs inside insulating layer 10. In this case, first conductive layer 15, 16 is implemented as tubular and has an essentially annular cross-section, as shown in FIG. 2. Insulating layer 10, which is enclosed by first conductive layer 15, 16, is also implemented as tubular and has an essentially annular cross-section, as shown in FIG. 2. Second conductive layer 20, which is enclosed by insulating layer 10 and is implemented as cylindrical, so that it essentially forms a circular surface in cross-section as shown in FIG. 2, then runs inside insulating layer 10. Second conductive layer 20 is connected to first conductive layer 15, 16 in an electrically conductive way in the region of a combustion chamber side tip 40 of pin heater 1, in which insulating layer 10 exposes second conductive layer 20, first conductive layer 15, 16 enclosing insulating layer 10 and second conductive layer 20 in an approximately U-shaped way in cross-section in the region of combustion chamber side tip 40 of pin heater 1, as shown in FIG. 1.

First conductive layer 15, 16, second conductive layer 20, and insulating layer 10 each include a ceramic composite structure. The ceramic composite structure used for insulating layer 10 has a significantly higher specific electrical resistance in this case than the ceramic composite structure used for conductive layers 15, 16, 20. In this way, leakage currents between first conductive layer 15, 16 and second conductive layer 20, with the exception of the region of combustion chamber side tip 40 of pin heater 1, in which first conductive layer 15, 16 is connected to second conductive layer 20, are largely suppressed.

Now, for example, first conductive layer 15, 16 may be connected to an operating voltage potential 30, such as a positive terminal of the vehicle battery, and second conductive layer 20 may be connected to a reference potential 25, such as the vehicle frame. In this case, first conductive layer 15, 16 represents the supply line and second conductive layer 20 represents the outgoing line for the heating current. However, in an especially advantageous way, second conductive layer 20 is connected to operating voltage potential 30 and first conductive layer 15, 16 is connected to reference potential 25, as shown in FIG. 1. In this case, second conductive layer 20 is the supply line and first conductive layer 15, 16 is the outgoing line for the heating current. As the supply line, second conductive layer 20 is already insulated to the outside by insulating layer 10 in this case. Since first conductive layer 15, 16 is already provided for the connection to reference potential 25, it does not matter if it comes into contact with the vehicle frame and/or reference potential 25, so that first conductive layer 15, 16 does not have to be insulated to the outside again. The diameter of pin heater 1 may be 3.3 mm in this case, for example.

To elevate the electrical resistance in the region of tip 40 of pin heater 1, as shown in FIG. 1, first conductive layer 15, 16 may be made of a first ceramic material 16 in the region of combustion chamber side tip 40 of pin heater 1, while in contrast first conductive layer 15, 16 is otherwise made of a second ceramic material 15. In this case, at the temperatures occurring during operation of pin heater 1, first ceramic material 16 has a higher electrical resistivity than second ceramic material 15 and second conductive layer 20. First ceramic material 16 encloses insulating layer 10 and second conductive layer 20 in a U-shape in longitudinal section as shown in FIG. 1. Through the elevated electrical resistance in the region of combustion chamber side tip 40 of pin heater 1 thus implemented, the heating of pin heater 1 is concentrated in the region of combustion chamber side tip 40 of pin heater 1 and is therefore displaced as much as possible into the combustion chamber of the internal combustion engine. In this way, a short heating time from −20° C. up to temperature of 1000° C. of an order of magnitude of 2 sec. and an equilibrium temperature of more than 1200° C. may be implemented.

On the basis of the cross-section of pin heater 1 along section line A—A in FIG. 1 shown in FIG. 2, it may be seen that in this first embodiment of pin heater 1, first conductive layer 15, 16, insulating layer 10, and second conductive layer 20 are arranged essentially coaxially to one another. In this case, first conductive layer 15, 16 and insulating layer 10 are each implemented as essentially annular in cross-section. Second conductive layer 20 essentially has the shape of an annular surface in cross-section. Therefore, an arrangement of first conductive layer 15, 16, second conductive layer 20, and insulating layer 10 which is essentially rotationally symmetric in cross-section results. During manufacturing, pin heater 1 is heated, gaseous substances being separated out of first conductive layer 15, 16, insulating layer 10, and second conductive layer 20. This results in shrinkage of these layers. Such shrinkage does not occur if pin heater 1 is manufactured using a sintering process, a hot press process, a hot isostatic press process, or a similar method. Insulating layer 10 shrinks differently from each of the two conductive layers, due to its composition, which differs from that of first conductive layer 15, 16 and that of second conductive layer 20. Because all layers 10, 15, 16, 20 are arranged rotationally symmetrically, all of layers 10, 15, 16, 20 shrink isotropically in this case, so that lower mechanical stresses due to shrinkage differences result.

Cyclic heating and cooling of pin heater 1 occurs during operation of pin heater 1 in the cylinder head. Because the materials for insulating layer 10 differ from those for first conductive layer 15, 16 and second conductive layer 20, the thermal expansion of insulating layer 10 differs in this case from that of first conductive layer 15, 16 and second conductive layer 20. The thermally induced mechanical stresses forming in this case are significantly reduced because of the rotational symmetry.

A further advantage of the essentially concentric and rotationally symmetric arrangement of layers 10, 15, 16, 20 of pin heater 1 also results in better concentricity of pin heater 1, even if the layers are not exactly concentric, but are arranged off-center due to manufacturing tolerances.

The essentially rotationally symmetric arrangement of layers 10, 15, 16, 20 of pin heater 1 shown in FIG. 2 also has the advantage that a slightly off-center position of insulating layer 10, because of manufacturing tolerances, does not result in a change in the electrical resistance behavior of pin heater 1, since both the cross-sectional area of second conductive layer 20 and the cross-sectional area of first conductive layer 15, 16 are not changed.

Figure 3:
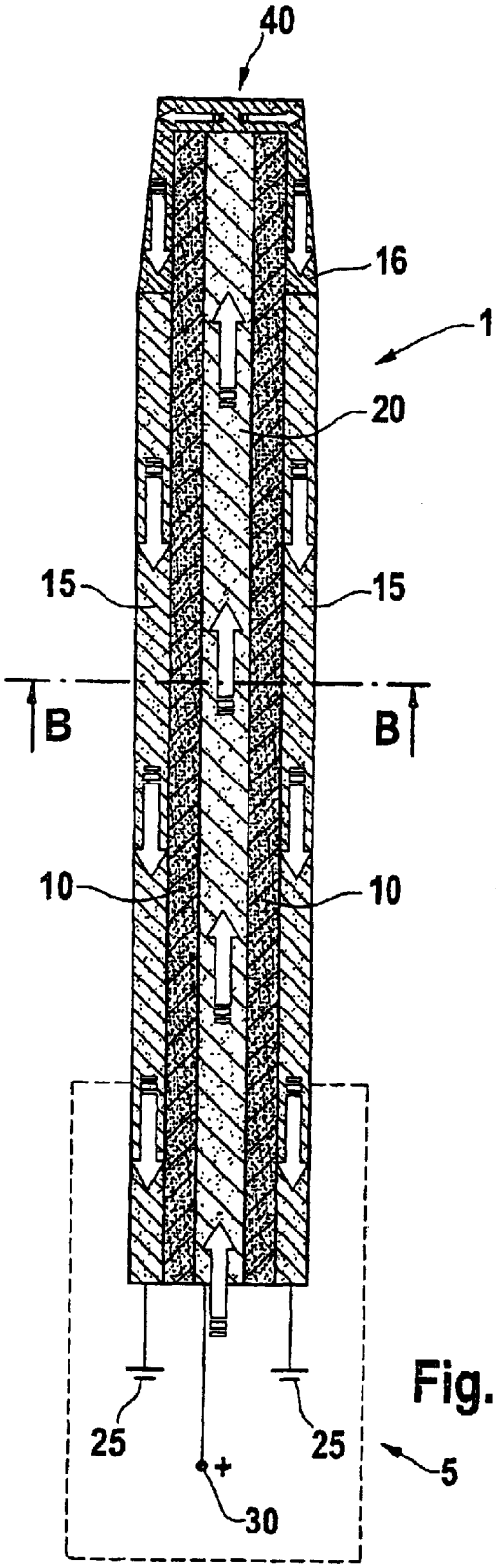
FIG. 3 shows a longitudinal section through a pin heater of a sheathed-element glow plug according to a second embodiment.
Figure 4:
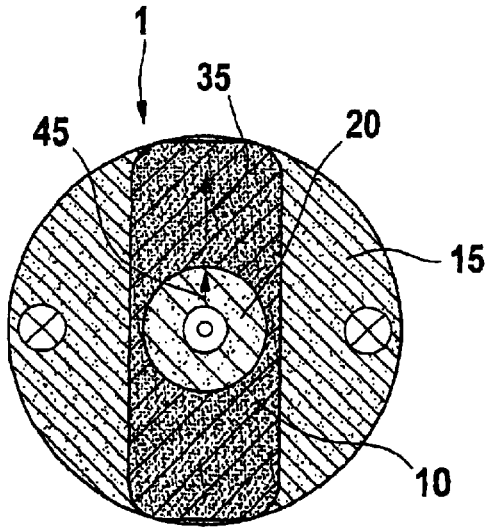
FIG. 4 shows a cross-section of this pin heater according to the second embodiment.

In a second exemplary embodiment shown in FIG. 3 and FIG. 4, in which identical reference numbers identify identical elements as in the first exemplary embodiment shown in FIGS. 1 and 2, the pin heater is again shown in longitudinal section in FIG. 3. FIG. 4 then shows the cross-section of pin heater 1 along a section line B—B shown in FIG. 3.

First conductive layer 15, 16 is also made of first ceramic material 16 in the region of combustion chamber side tip 40 of pin heater 1 and is otherwise made of second ceramic material 15 in the second exemplary embodiment shown in FIG. 3, first ceramic material 16 having a higher electrical resistivity than second ceramic material 15. Alternatively or, as shown in FIG. 3, additionally, the proportion of insulating layer 10 in the overall cross-section increases in the region of combustion chamber side tip 40 of pin heater 1, while the proportion of both conductive layers 15, 16, 20 in the overall cross-section is reduced. This is implemented, as shown in FIG. 3, in such a way that the cross-section of insulating layer 10 and second conductive layer 20 remains the same, while in contrast the cross-section of first conductive layer 15, 16 is reduced toward combustion chamber side tip 40 in the region of combustion chamber side tip 40 of pin heater 1. In this case, the cross-sectional area of insulating layer 10 may remain the same, as shown in FIG. 3. The cross-sectional area of second conductive layer 20 may also remain the same in this case, as shown in FIG. 3. In this case, as shown in FIG. 3, the overall cross-section is reduced toward combustion chamber side tip 40 of pin heater 1. Alternatively, the reduction of the cross-section of first conductive layer 15, 16 toward combustion chamber side tip 40 of pin heater 1 may be combined with an enlargement of the cross-sectional area of insulating layer 10 toward combustion chamber side tip 40, so that the overall cross-section of pin heater 1 remains essentially the same over its entire length. The goal of these measures is, as in the second exemplary embodiment, an increase in the electrical resistance in the region of combustion chamber side tip 40 of pin heater 1, in order to concentrate the heating output there.

The cross-section along section line B—B shown in FIG. 4 is outside the region of the cross-sectional tapering of pin heater 1, but is also qualitatively relevant for the region of the cross-sectional tapering in the region of combustion chamber side tip 40 shown in FIG. 3. First conductive layer 15, 16, second conductive layer 20, and insulating layer 10 are essentially concentric to one another, but are no longer arranged rotationally symmetrically. This is because, in comparison to insulating layer 10 in the first embodiment, in the second embodiment insulating layer 10 has a preferred direction 35 in cross-section, in which it is more elongated than in at least one other direction,. Thus, as shown in FIG. 4, insulating layer 10 is elongated in preferred direction 35 up to the outer edge of pin heater 1, so that first conductive layer 15, 16 is divided into two parts outside the region of combustion chamber side tip 40. Insulating layer 10 does not have to be elongated up to the edge of pin heater 1 in its preferred direction 35, however, so that the above-described division of first conductive layer 15, 16 into two parts is not absolutely necessary. By using preferred direction 35 for insulating layer 10, the advantage results that bending of insulating layer 10 may be largely avoided during its bonding to first conductive layer 15, 16 during the manufacturing process of pin heater 1, so that pin heater 1 may be implemented as more mechanically robust overall than is possible in the rotationally symmetric arrangement according to the first exemplary embodiment. Although it is not shown in FIG. 4, second conductive layer 20 may also have a preferred direction 45 in cross-section, alternatively or additionally to insulating layer 10, in which it is elongated compared to at least one other direction. In this way, bending of second conductive layer 20 during bonding to insulating layer 10 may also be largely avoided during the manufacturing of pin heater 1. The mechanical robustness of pin heater 1 is also increased by this measure in comparison to the rotationally symmetric arrangement according to the first except embodiment. If bending of both second conductive layer 20 and insulating layer 10 is to be avoided during manufacturing of pin heater 1, both insulating layer 10 and second conductive layer 20 are to have a preferred direction in cross-section, in which they are elongated compared to at least one other direction.

If insulating layer 10 has preferred direction 35, as shown in FIG. 4, the electrical insulation effect maybe amplified in this direction and the formation of leakage currents between second conductive layer 20 and first conductive layer 15, 16 may be significantly reduced.

The shaping of pin heater 1 may be implemented as a cost-effective mass production method using an injection molding method, a transfer molding method, or a slip cast method. A composite ceramic may be used for first conductive layer 15, 16, second conductive layer 20, and insulating layer 10, which is implemented in the case of both conductive layers 15, 16, 20 as a matrix having conductive fillers. In this way, higher temperatures in use, higher corrosion resistance, and a longer service life may be implemented.

Because an external heater is implemented using first conductive layer 15, 16, the heating time of the pin heater may be shortened and quasi-immediate start of the internal combustion engine may be implemented even at −20° C., for example. By dispensing with external, electrical insulation of pin heater 1 due to second conductive layer 20, which is insulated by insulating layer 10 and connected to operating voltage potential 30, the manufacturing costs may be reduced. The diameter of pin heater 1 may be approximately 3.3 mm in this case, for example. Sheathed-element glow plug 5 having pin heater 1 described here may be installed into an M8 housing of the cylinder head, for example.

Because of the external heater implemented by first conductive layer 15, 16, a temperature of 1000° C. may be reached within a few seconds starting from −20° C. and an equilibrium temperature of more than 1200° C. may be reached. The heating time may be reduced in this case if, as described, the resistance of first ceramic material 16 is increased in relation to the resistance of second ceramic material 15 and the resistance of second conductive layer 20. The equilibrium temperature may also be increased through this measure. Second conductive layer 20 is also located inside insulating layer 10 in the second exemplary embodiment, as in the first except embodiment.

What is claimed is:

1. A pin heater, in a sheathed-element glow plug for an internal combustion engine, comprising:

at least one internal insulating layer;

an external first conductive layer, the at least one internal insulating layer and the external first conductive layer including ceramic composite structures;

a combustion chamber side tip; and a second conductive layer including another ceramic composite structure, the second conductive layer being bonded to the external first conductive layer in a region of the combustion chamber side tip, wherein the second conductive layer runs inside the at least one internal insulating layer;

wherein:

a proportion of the at least one internal insulating layer on an overall cross-section increases in the region of the combustion chamber side tip, and a combined proportion of the external first conductive layer and the second conductive layer on the overall cross-section is reduced.

2. The pin heater as recited in claim 1, wherein:

the external first conductive layer is connected to a reference potential, and the second conductive layer is connected to an operating voltage potential.

3. The pin heater as recited in claim 2, wherein:

the reference potential includes a vehicle frame, and the operating voltage potential includes a positive terminal of a vehicle battery.

4. The pin heater as recited in claim 1, wherein:

the external first conductive layer, the second conductive layer, and the at least one internal insulating layer are arranged coaxially to one another.

5. The pin heater as recited in claim 1, wherein:

the external first conductive layer, the second conductive layer, and the at least one internal insulating layer are arranged rotationally symmetrically to one another in cross-section.

6. The pin heater as recited in claim 1, wherein:

the external first conductive layer and the at least one internal insulating layer are implemented as annular in cross-section, and the second conductive layer forms a circular surface in cross-section.

7. The pin heater as recited in claim 1, wherein:

the at least one internal insulating layer has a direction in cross-section, in which the at least one internal insulating layer is more elongated compared to at least one other direction.

8. The pin heater as recited in claim 1, wherein:

the second conductive layer has a direction in cross-section, in which the second conductive-layer is more elongated compared to at least one other direction.

9. The pin heater as recited in claim 1, wherein:

the external first conductive layer includes:

a first ceramic material in the region of the combustion chamber side tip, and a second ceramic material, and the first ceramic material has a higher specific electrical resistivity than that of the second ceramic material.

10. A sheathed-element glow plug, comprising:

a pin heater including:

at least one internal insulating layer;

an external first conductive layer, the at least one internal insulating layer and the external first conductive layer including ceramic composite structures;

a combustion chamber side tip; and a second conductive layer including another ceramic composite structure, the second conductive layer being bonded to the external first conductive layer in a region of the combustion chamber side tip, wherein the second conductive layer runs inside the at least one internal insulating layer;

wherein:

a proportion of the at least one internal insulating layer on an overall cross-section increases in the region of the combustion chamber side tip, and a combined proportion of the external first conductive layer and the second conductive layer on the overall cross-section is reduced.

11. The sheathed-element glow plug as recited in claim 10, wherein:

the external first conductive layer is connected to a reference potential, and the second conductive layer is connected to an operating voltage potential.

12. The sheathed-element glow plug as recited in claim 11, wherein:

the reference potential includes a vehicle frame, and the operating voltage potential includes a positive terminal of a vehicle battery.

13. The sheathed-element glow plug as recited in claim 10, wherein:

the external first conductive layer, the second conductive layer, and the at least one internal insulating layer are arranged coaxially to one another.

14. The sheathed-element glow plug as recited in claim 10, wherein:

the external first conductive layer, the second conductive layer, and the at least one internal insulating layer are arranged rotationally symmetrically to one another in cross-section.

15. The sheathed-element glow plug as recited in claim 10, wherein:

the external first conductive layer and the at least one internal insulating layer are implemented as annular in cross-section, and the second conductive layer forms a circular surface in cross-section.

16. The sheathed-element glow plug as recited in claim 10, wherein:

the at least one internal insulating layer has a direction in cross-section, in which the at least one internal insulating layer is more elongated compared to at least one other direction.

17. The sheathed-element glow plug as recited in claim 10, wherein:

the second conductive layer has a direction in cross-section, in which the second conductive layer is more elongated compared to at least one other direction.

18. The sheathed-element glow plug as recited in claim 10, wherein:

the external first conductive layer includes:

a first ceramic material in the region of the combustion chamber side tip, and a second ceramic material, and the first ceramic material has a higher specific electrical resistivity than that of the second ceramic material.

* * * * *